US007190383B2

(12) United States Patent
Satoh

(10) Patent No.: US 7,190,383 B2
(45) Date of Patent: Mar. 13, 2007

(54) MISALIGNMENT DETECTOR AND IMAGE FORMING APPARATUS

(75) Inventor: Nobuyuki Satoh, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 212 days.

(21) Appl. No.: 10/735,691

(22) Filed: Dec. 16, 2003

(65) Prior Publication Data

US 2004/0263607 A1 Dec. 30, 2004

(30) Foreign Application Priority Data

Dec. 16, 2002 (JP) ..... 2002-364071

(51) Int. Cl.
*B41J 2/385* (2006.01)
*B41J 2/435* (2006.01)

(52) U.S. Cl. ..... 347/116; 347/234; 347/248

(58) Field of Classification Search ..... 347/116–117, 347/229, 234–235, 248–250; 355/20; 358/1.9; 356/152.2, 399–401, 369; 399/165, 301; 422/91

See application file for complete search history.

(56) References Cited

U.S. PATENT DOCUMENTS

| | | | | |
|---|---|---|---|---|
| 3,712,740 | A * | 1/1973 | Hennings | 356/152.2 |
| 4,760,427 | A | 7/1988 | Oyama et al. | 355/32 |
| 4,866,478 | A | 9/1989 | Kasahara et al. | 355/70 |
| 4,912,491 | A * | 3/1990 | Hoshino et al. | 347/116 |
| 5,030,986 | A * | 7/1991 | Dwyer, III | 355/20 |
| 5,205,988 | A * | 4/1993 | Tanaka et al. | 422/91 |
| 5,587,813 | A | 12/1996 | Yamazaki et al. | 358/500 |
| 5,867,759 | A | 2/1999 | Isobe et al. | 399/301 |
| 6,049,690 | A * | 4/2000 | Nakayasu et al. | 399/301 |
| 6,181,363 | B1 | 1/2001 | Satoh | 347/238 |
| 6,285,849 | B1 * | 9/2001 | Shimada et al. | 399/301 |
| 6,417,922 | B1 * | 7/2002 | Dirksen et al. | 356/401 |
| 6,690,469 | B1 * | 2/2004 | Shibata et al. | 356/369 |
| 2003/0053093 | A1 * | 3/2003 | Eom | 358/1.9 |

FOREIGN PATENT DOCUMENTS

| | | |
|---|---|---|
| JP | 6-1002 | 1/1994 |
| JP | 6-18796 | 1/1994 |
| JP | 06001002 A * | 1/1994 |
| JP | 2000-267027 | 9/2000 |
| JP | 2001-13432 | 1/2001 |
| JP | 3253227 | 2/2002 |

* cited by examiner

*Primary Examiner*—Hai Pham
(74) *Attorney, Agent, or Firm*—Oblon, Spivak, McClelland, Maier & Neustadt, P.C.

(57) ABSTRACT

A misalignment detector includes a light source, a synthesizing unit, a focusing unit, an image sensor, and a misalignment calculator. The light source, the synthesizing unit, the focusing unit, and the image sensor are arranged in such a manner that light illuminated by the light source passes through the synthesizing unit so as to illuminate the position detection pattern, gets reflected from the position detection pattern, passes through the synthesizing unit so as to be focused by the focusing unit on the image sensor. A misalignment calculator detects an amount of misalignment of the laser beams based on an image formed in the image sensor.

8 Claims, 3 Drawing Sheets

MISALIGNMENT DETECTOR AND IMAGE FORMING APPARATUS

CROSS-REFERENCE TO RELATED APPLICATIONS

The present document incorporates by reference the entire contents of Japanese priority document, 2002-364071 filed in Japan on Dec. 16, 2002.

BACKGROUND OF THE INVENTION

1) Field of the Invention

The present invention relates to a misalignment detector for detecting misalignment of sources of laser beams that scan a photosensitive drum in an image forming apparatus.

2) Description of the Related Art

Image forming apparatuses that form one image by forming a latent image on a photosensitive drum by each of a plurality of laser beams have been disclosed in, for example, Japanese Patent Application Laid-open Publication No. 2000-267027, Japanese Patent Application Laid-open Publication No. H6-18796, and Japanese Patent Application Laid-open Publication No. H6-1002.

According to the technology disclosed in Japanese Patent Application Laid-open Publication No. 2000-267027, a plurality of writing optical systems are provided along a main scanning direction and the images are joined to thereby form a wide image. This technology makes it possible to realize a low cost.

According to the technology disclosed in Japanese Patent Application Laid-open Publication No. H6-18796, separate images are written on each of a plurality of photosensitive drums by independent laser beams, each image is developed by toners of corresponding color, and the single color images are transferred, in a superimposed manner, onto a paper to obtain a multi color image. This technology is widely known as a tandem-type image forming.

According to the technology disclosed in Japanese Patent Application Laid-open Publication No. H6-1002, a plurality of writing optical systems that irradiate different laser beams write corresponding images on one photosensitive drum.

Thus, all the technologies mentioned above use a plurality of laser beams that perform scanning. However, scanning positions of the laser beams change with the temperature or the environment. Moreover, wavelength of the laser beam also changes with a change in the temperature of a laser diode that emits the laser beam. Following problems arise if the scanning positions of the laser beam change. In the technology disclosed in the Japanese Patent Application Laid-open Publication No. 2000-267027, white lines and black lines are formed at a joint between the images resulting in a deterioration of the image. In the technologies disclosed in Japanese Patent Application Laid-open Publication No. H6-18796 and H6-1002, there is a possibility of shift in image of different colors, color unevenness, spreading of color etc. resulting in deterioration of the image.

One approach to solve these problems, as disclosed in Japanese Patent No. 3253227, is to detect a position of a mark that is formed in the image and correct the beam position according to the position of the mark. Particularly, to achieve high accuracy of detection of position-shift (particularly, to minimize an error in upward and downward movement of a pattern), a plurality of light emitting diodes (LED), each of which forms a mark ("register mark") on the transfer belt, have been provided.

However, the requirement of a plurality of LED increases the cost. One approach to reduce the cost may be to use one LED and condense the light if that LED using a condenser lens. However, not much cost reduction is realized even with this approach. On the contrary, minimum focal length of a lens in the detecting optical system is 8 mm, shortest conjugate length (while forming a magnified image) is approximately 8×4+ distance between principal points of lens is not less than 35 mm, and including the size of a CCD and the thickness of a circuit board, the height becomes about 40 mm. As a result, the equipment becomes bulky.

SUMMARY OF THE INVENTION

It is an object of the present invention to solve at least the problems in the conventional technology.

A misalignment detector according to one aspect of the present invention is used in an image forming apparatus in which a latent image is formed on a photosensitive drum by using a plurality of laser beams to detect misalignment of each laser beam based on an image formed on an image sensor of a position detection pattern that is formed on an image carrier. This misalignment detector includes a light source that outputs light; a synthesizing unit that passes the light of the light source so as to illuminate the position detection pattern, and collects and reflects a light reflected from the position detection pattern; and a focusing unit that that focuses the light reflected from the synthesizing unit on the image sensor.

A misalignment detector according to another aspect of the present invention is used to detect misalignment of laser beams that form latent images on a photosensitive drum based on detection of a position detection pattern on an image carrier. The misalignment detector includes a light source, a synthesizing unit, a focusing unit, an image sensor, and a misalignment calculator that detects the misalignment of the laser beams based on an image formed in the image sensor. In this misalignment detector, the light source, the synthesizing unit, the focusing unit, and the image sensor are arranged in such a manner that light illuminated by the light source passes through the synthesizing unit so as to illuminate the position detection pattern, gets reflected from the position detection pattern, passes through the synthesizing unit so as to be focused by the focusing unit on the image sensor.

An image forming apparatus according to still another aspect of the present invention includes a photosensitive drum to form a latent image by each of a plurality of laser beams; an image carrier with a position detection pattern; and a misalignment-detector that detects misalignment of the laser beams, the misalignment detector including a light source, a synthesizing unit, a focusing unit, an image sensor, and a misalignment calculator that detects the misalignment of the laser beams based on an image formed in the image sensor. The light source, the synthesizing unit, the focusing unit, and the image sensor are arranged in such a manner that light illuminated by the light source passes through the synthesizing unit so as to illuminate the position detection pattern, gets reflected from the position detection pattern, passes through the synthesizing unit so as to be focused by the focusing unit on the image sensor.

The other objects, features and advantages of the present invention are specifically set forth in or will become apparent from the following detailed descriptions of the invention when read in conjunction with the accompanying drawings.

DETAILED DESCRIPTION

Figure 1:
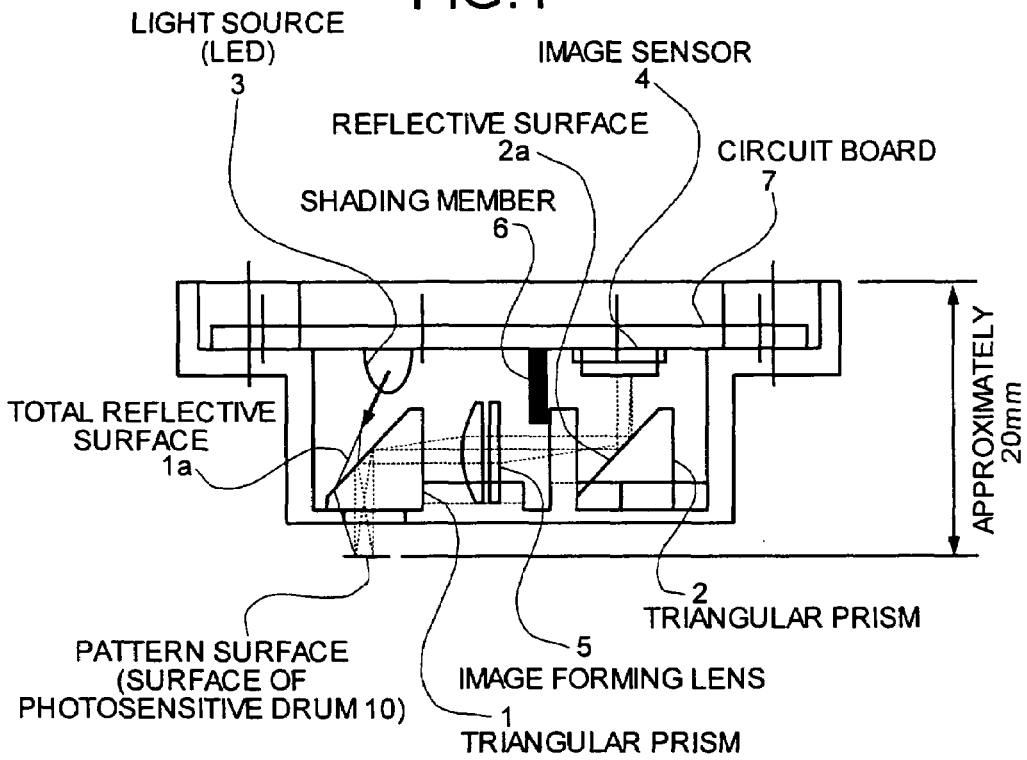
FIG. 1 is a side view of an image forming apparatus according to an embodiment of the present invention.

Exemplary embodiments of a misalignment detector and an image forming apparatus according to the present invention are explained below while referring to the accompanying diagrams. FIG. 1 is a side view of an image forming apparatus according to an embodiment of the present invention. This image forming apparatus includes a misalignment detector that includes a triangular prism 1, a triangular prism 2, a light source 3, an image sensor 4, an image forming lens 5, a shading member 6, and a circuit board 7. The triangular prism 1 has a total reflective surface 1*a* and the triangular prism 2 has a reflective surface 2*a*. The image sensor 4 and the light source 3 are mounted on the circuit board 7.

Figure 3:
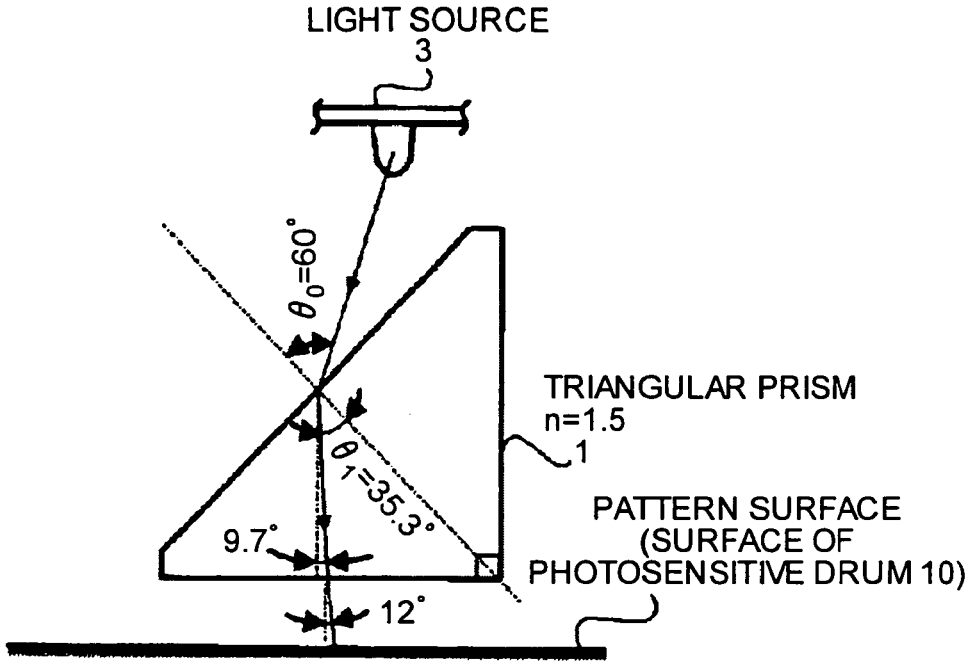
FIG. 3 is an illustration to explain a principle of mark detection according to the present invention.

Light beam output from the light source 3 (LED) enters the triangular prism 1 from the total reflective surface 1*a* and is irradiated to a surface of a photosensitive drum 10 (see FIG. 3). This light beam is reflected (hereinafter, "reflected light beam") from the surface of the photosensitive drum 10 back to the triangular prism 1. The reflected light beam is reflected at right angles at the total reflective surface 1*a* of the triangular prism 1.

When the reflected light beam is reflected from the total reflective surface 1*a*, the reflected light beam travels parallel to the surface of the photosensitive drum 10 so that there is no need to increase the distance between the misalignment detector and the photosensitive drum 10. The reflected light beam then passes through the image forming lens 5 and is reflected at the reflective surface 2*a* of the triangular prism 1. Finally, an image corresponding to the reflected light beam is formed on the image sensor 4.

A surface of the triangular prism 2 is subjected to a treatment like aliminization to form the reflective surface 2*a*. It is sufficient that there is a reflective surface and it is not necessary to provide the triangular prism. When the optical axis is not to be reflected (returned) back, if a lens having a focal length of approximately 8 mm is used, the height has to be not less than 40 mm. However, according to the present embodiment, the overall size can be made reduced to half, i.e. less than 20 mm. Moreover, as the image sensor 4 and the light source 3 are mounted on the same circuit board 7, the number of components is reduced. This results into cost and size reduction.

The misalignment detector according to the present invention may be used in combination with the technologies disclosed in the Japanese Patent Applications Laid-open Publication Nos. 2000-267027, H6-18796, and H6-1002.

Figure 2:
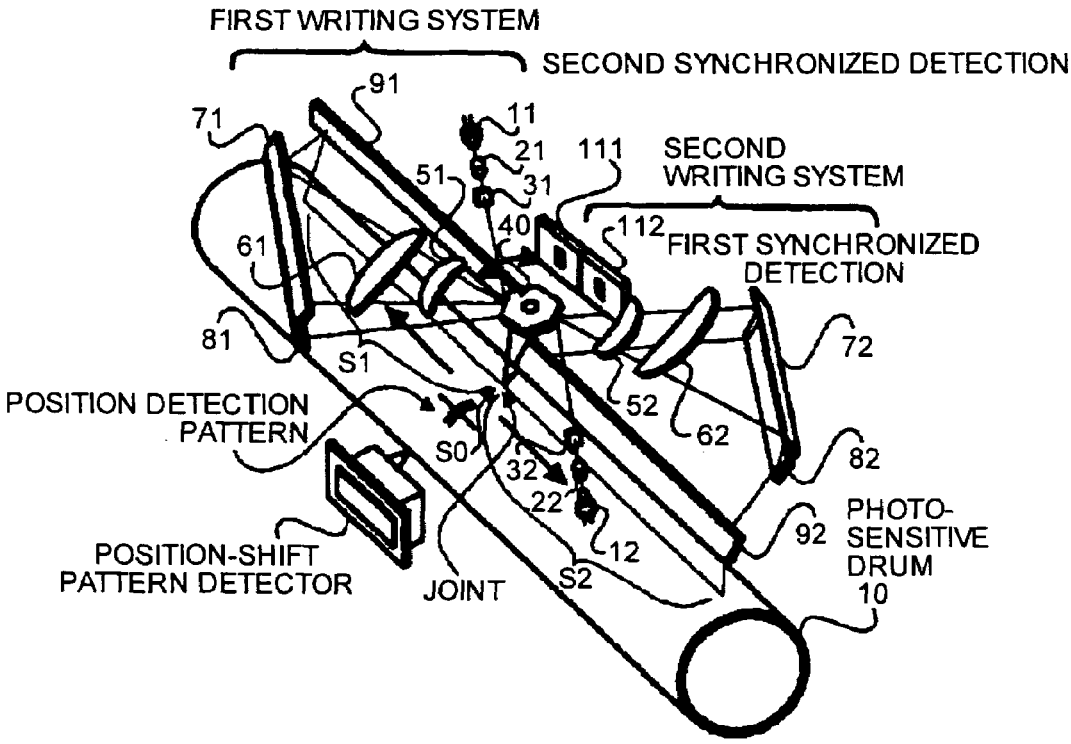
FIG. 2 is a perspective view of the image forming apparatus according to the embodiment.

FIG. 2 illustrates an example of an image forming apparatus, which is disclosed in Japanese Patent Application Laid-open Publication No. 2000-267027, into which the misalignment detector according to the present invention is employed. In this image forming apparatus, an optical scanner scans two areas on a surface of the photosensitive drum 10 with a respective beam. This optical scanner includes a first writing system and a second writing system.

The first writing system includes a semiconductor laser 11, as a light source, that emits intensity modulated laser beam corresponding to an image signal. A coupling lens 21 collimates the laser beam into a parallel laser beam. A cylinder lens 31 converges the laser beam in only a secondary scanning direction. A polygon mirror 40 deflects the laser beam.

The laser beam passes through a lens fθ that is formed by lenses 51 and 61 and reflected from mirrors 71, 81, and a returning (reflecting) mirror 91, one after the other. The reflected beam forms a beam spot on the photosensitive surface (the surface that is subjected to scanning) of the photoconductive photosensitive drum 10 and scans a first scanning area S1 of the photosensitive drum 10 at a constant speed. The second writing system is disposed in a position where the first writing system is rotated through 180 degrees with axis of rotation of the polygon mirror 40 as a center.

A semiconductor laser 12 which is a light source emits intensity modulated laser beam according to the image signal. The coupling lens 22 makes the laser beam a parallel beam. The parallel beam is converged by a cylinder lens 32 in the secondary scanning direction only. The converged beam forms an image as a long linear image in the main scanning direction around another area of deflected light by the polygon mirror 40. The beam that is deflected at a constant angular speed by the polygon mirror 40 passes through a lens fθ that is formed by lenses 52 and 62, and is reflected from mirrors 72, 82, and a returning mirror 92 one after the other. The reflected beam forms a beam spot on the photosensitive surface of the photosensitive drum 10 and scans a second scanning area S2 of the photosensitive drum 10 at a constant speed. The first and the second writing systems are equivalent optically. The first and the second writing systems perform writing in directions opposite to each other i.e. in directions towards two ends of the scanning area with joint of the first and the second scanning area S1 and S2, i.e. a center S0 of the overall scanning area as an origin (starting point). The first and the second writing systems include synchronized detectors 111 and 112 respectively. The synchronized detectors 111 and 112 are installed outside an image area of scanning beams and determine timing for start of scanning of scanning beam for each scan.

A writing controller (circuit) (not shown) starts writing from position of start of writing (the center S0 of the overall scanning area) according to the timing determined. Thus, the writing start position S0 for each scanning beam is common and is controlled appropriately by the synchronized detectors. As a result, a joint in the direction of the main scanning of each scanning beam can be matched appropriately.

The first and the second scanning areas S1 and S2 have to be linked as one straight line and are set to be fixed in an equipment space during designing stage of the equipment. An ideal scanning line that is set to be fixed in an equipment space is to be scanned simultaneously by the two beams and is an axis of a surface to be scanned. In other words, ideally, both of the first and the second scanning areas S1 and S2 have to coincide with the surface to be scanned and be linked at the center S0.

In the joint of the first writing system and the second writing system in the diagram, a position detection pattern is output and is visualized by a visualizing unit (developing unit) that is not shown in the diagram. The misalignment detector that is disposed in a downstream side of the direction of rotation of the photosensitive drum (refer to FIGS. 1 and 2) reads an amount of shift in the position detection pattern that is visualized. A beam position controller that is not shown in the diagram performs correction of the position.

A beam-position correcting unit for performing correction in the secondary scanning direction has been proposed in Japanese Patent Application Laid-open Publication No. Hei9-15994 (optical scanner) and correction can be performed by using the known technology. A known technology can be used for performing correction in the main scanning direction.

Light incident on the triangular prism 1 is illustrated in FIG. 3. If an angle of incidence of light incident from the light source 3 on the inclined surface of the triangular prism is $\theta_0$, an angle of approach (angle of penetration) inside the triangular prism 1 is $\theta_1$, and the refractive index of the triangular prism is n1, according to Snell's law, the angle of approach (angle of penetration) θ1 is indicated by $$\theta_1=\sin-1((1/n1)\sin\theta_0).$$

As an example, if the angle of incidence $\theta_0$ is 60 degrees, $\theta_1$ is 35.3 degrees. In this case, the surface of the photosensitive drum 10 is the pattern surface for the position-shift detection and this surface is to be a surface that holds the visualized image. A transfer paper, a carrier material of an image carrier may be used in place of this surface. A bottom surface of the prism is disposed almost in parallel to the pattern surface and since the inclined surface is at 45 degrees with respect to the bottom surface of the prism, the light falls almost vertically on the pattern surface.

Practically, since there is refraction at a surface from where the light is output from the prism, when $\theta_0$ is 60 degrees, angle of light beam on the pattern surface becomes 13 degrees. If the angle $\theta_0$ is about 13 degrees, the position detection error that occurs due to a shadow of unfixed toner image can be minimized to a level such that the error is negligible. Since, a plurality of light sources are not required, this can be realized at low cost.

Figure 4:
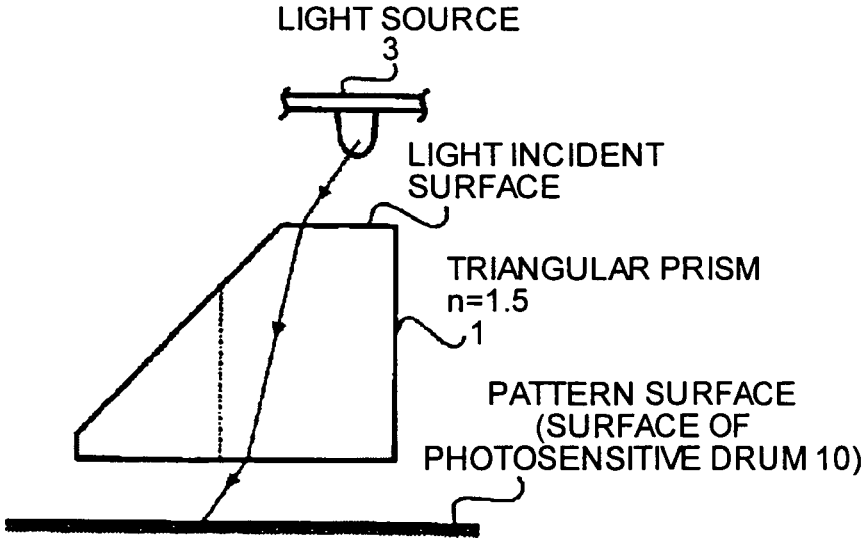
FIG. 4 is an illustration to explain another principle of mark detection according to the present invention.

Another example of a unit to synthesize the light is shown in FIG. 4. In this example, instead of allowing the light to enter from the inclined surface of the triangular prism 1, a champhered portion is increased and the light is allowed to enter from the champhered area.

Figure 5:
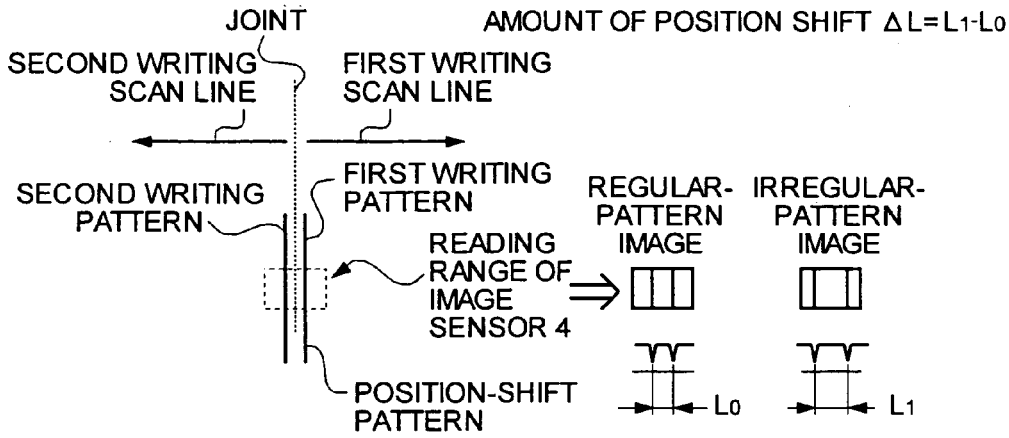
FIG. 5 is an illustration of a line pattern to detect a position-shift of beam in a main scanning direction.
Figure 6:
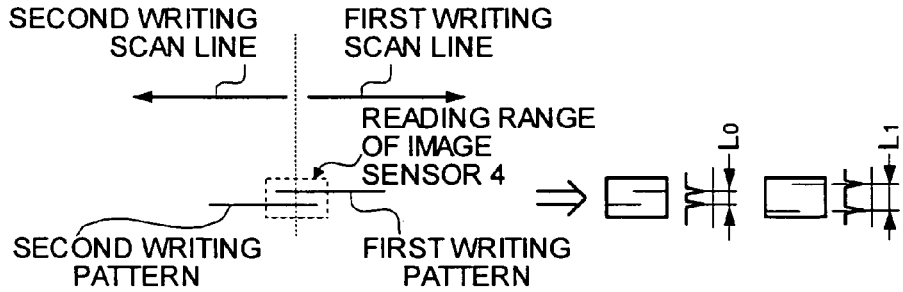
FIG. 6 is an illustration of a line pattern to detect a position-shift of beam in a secondary scanning direction.

Illustrations when the pattern for position-shift detection is formed as lines are shown in FIGS. 5 and 6. FIG. 5 illustrates an example of a line pattern for detecting a beam-shift in the main scanning direction and FIG. 6 illustrates an example of a line pattern for detecting a beam-shift in the secondary scanning direction.

In the example in the main scanning direction, a pattern is formed in a reading range of the image sensor 4 such that the respective lines do not coincide. In this case, the distance between the lines is referred to as L0. The lines are formed in the main scanning direction and in the vertical direction. To start with, outputs from the image sensor 4 are added up in the secondary scanning direction and referred to as one-dimensional data. Distance is measured at a peak (or a minimum value) of the lines and the measured distance is referred to as distance between the lines. During the measurement, if there is no shift, the distance is measured as L0. If there is a shift in the main scanning direction, the variation in distance shown by L1 is measured. The amount of position-shift ΔL can be calculated by $$\Delta L=L1-L0.$$

Since the lines are formed in parallel to the secondary scanning direction and the measurement of the main scanning is not affected by the secondary scanning shift (occurring due to optical shift and speed unevenness of the photosensitive drum), the measurement can be performed with high accuracy.

While measuring the secondary scanning shift, as it is shown in FIG. 6, the lines parallel to the main scanning direction are formed in the reading range of the image sensor 4 such that the respective lines do not coincide. Further, outputs from the image sensor 4 are added up in the main scanning direction and referred to as one-dimensional data. Distance is measured at a peak (or a minimum value) of the lines and the measured distance is referred to as distance between the lines. During the measurement, if there is no shift, the distance is measured as L0. If there is a shift in the secondary scanning direction, the variation in distance shown by L1 is measured. The amount of position shift ΔL can be calculated by $$\Delta L=L1-L0.$$

Since the lines are formed in parallel to the main scanning direction, the measurement of the secondary scanning is not affected by the main scanning shift (occurring due to magnification error etc. of the optical system), the measurement can be performed with high accuracy.

Figure 7:
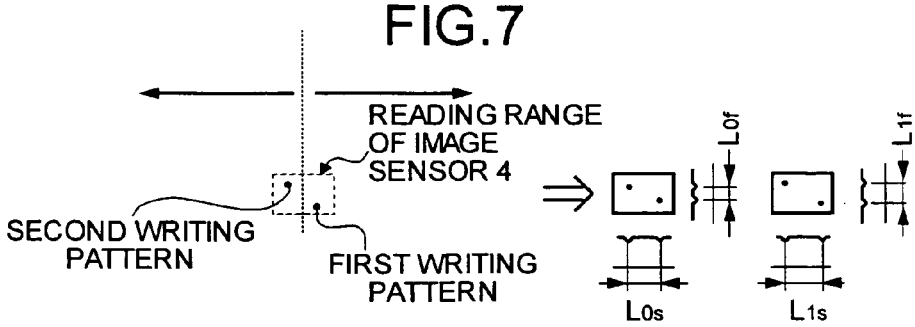
FIG. 7 is an illustration of a pattern to measure the position-shift in the main and the secondary scanning directions simultaneously.

An example of a pattern while measuring the position-shift in main and the secondary scanning directions simultaneously, is shown in FIG. 7. A pattern is formed as independent dots in a position where the respective positions do not coincide even after adding up in the main and the secondary scanning directions. Size of a dot is set according to the sensitivity of the sensor. Outputs from the image sensor 4 are added up in the main and the secondary scanning directions and referred to as one-dimensional data. Although the S/N ratio of the output deteriorates to some extent as compared to the line pattern, since the position of the peak is detected, the detection is performed without considerable deterioration of detection accuracy. The method of shift detection is the same as for the line pattern.

Figure 8:
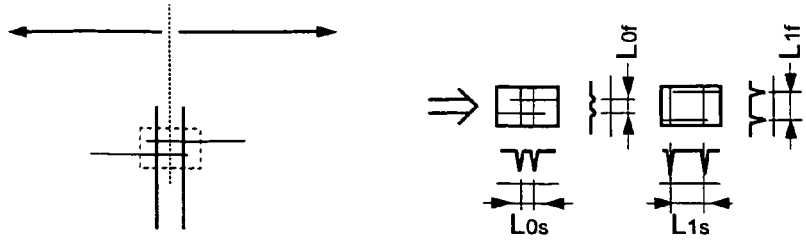
FIG. 8 is an illustration of a line pattern to detect the position-shift in the main and the secondary scanning directions simultaneously.

An example in which the detection of the position-shift in the main and the secondary scanning directions is possible simultaneously is illustrated in FIG. 8 (The method of detection is the same as in FIG. 7).

The misalignment detector according to the present invention may be employed in the technologies disclosed in the Japanese Patent Applications Laid-open Publication Nos. H6-18796 and H6-1002.

According to the present invention, a misalignment detector that is efficiently, cheaper, and small can be obtained.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A misalignment detector in an image forming apparatus in which a latent image is formed on an image carrier by using a plurality of laser beams, the misalignment detector detects a position-shift of each laser beam, comprising:

a two-dimensional image sensor configured to read a position detection pattern that is formed on an image carrier;

a light source that outputs light;

a synthesizing unit configured to refract input light from the light source and to pass the light of the light source so as to illuminate the position detection pattern, and collects and reflects a light reflected from the position detection pattern; and a focusing unit that focuses the light reflected from the synthesizing unit on the image sensor;

an adding unit that adds up image data of the two-dimensional image sensor in any one of the main scanning direction and the secondary scanning direction; and a peak-position detector that detects a peak position in one-dimensional data that is output by the adding unit, wherein the position detection pattern includes a plurality of lines that are parallel to each other.

2. The misalignment detector according to claim 1, wherein the light synthesizing unit includes a prism.

3. The misalignment detector according to claim 1, wherein the image sensor and the light source are mounted on a same circuit board.

4. A misalignment detector in an image forming apparatus in which a latent image is formed on an image carrier by using a plurality of laser beams, the misalignment detector detects a position-shift of each laser beam, comprising:

a two-dimensional image sensor configured to read a position detection pattern that is formed on an image carrier;

a light source that outputs light;

a synthesizing unit configured to refract input light from the light source and to pass the light of the light source so as to illuminate the position detection pattern, and collects and reflects a light reflected from the position detection pattern; and a focusing unit that focuses the light reflected from the synthesizing unit on the image sensor;

an adding unit that adds up image data of the two-dimensional image sensor in any one of the main scanning direction and the secondary scanning direction; and a peak-position detector that detects a peak position in one-dimensional data that is output by the adding units, wherein the position detection pattern includes dots of a predetermined size.

5. A misalignment detector in an image forming apparatus in which a latent image is formed on a photosensitive drum by using a plurality of laser beams, while achieving an independent image, the misalignment detector detects a position-shift of each laser beam based on an image formed on an image sensor of a position detection pattern that is formed on an image carrier, comprising:

a light source that outputs light;

a synthesizing unit that passes the light of the light source and refracts the light so as to illuminate the position detection pattern, collects a light reflected from the position detection pattern, and reflects the collected light off a first reflecting surface; and a focusing unit including a second reflecting surface that focuses the light reflected from the synthesizing unit on the image sensor, an adding unit that adds up image data of a two-dimensional image sensor in any one of the main scanning direction and the secondary scanning direction; and a peak-position detector that detects a peak position in one-dimensional data that is output by the adding unit;

wherein the position detection pattern includes a plurality of lines that are parallel to each other.

6. The misalignment detector according to claim 5, wherein the light synthesizing unit includes a prism.

7. The misalignment detector according to claim 5, wherein the image sensor and the light source are mounted on a same circuit board.

8. A misalignment detector in an image forming apparatus in which a latent image is formed on a photosensitive drum by using a plurality of laser beams, while achieving an independent image, the misalignment detector detects a position-shift of each laser beam based on an image formed on an image sensor of a position detection pattern that is formed on an image carrier, comprising:

a light source that outputs light;

a synthesizing unit that passes the light of the light source and refracts the light so as to illuminate the position detection pattern, collects a light reflected from the position detection pattern, and reflects the collected light off a first reflecting surface; and a focusing unit including a second reflecting surface that focuses the light reflected from the synthesizing unit on the image sensor;

an adding unit that adds up image data of a two-dimensional image sensor in any one of the main scanning direction and the secondary scanning direction; and a peak-position detector that detects a peak position in one-dimensional data that is output by the adding unit, wherein the position detection pattern includes dots of a predetermined size.

* * * * *